US011226131B2

(12) United States Patent
Moon et al.

(10) Patent No.: US 11,226,131 B2
(45) Date of Patent: Jan. 18, 2022

(54) AIR CONDITIONER

(71) Applicant: SAMSUNG ELECTRONICS CO., LTD., Suwon-si (KR)

(72) Inventors: Hong Yeol Moon, Hwaseong-si (KR); Hyun-Ho Kim, Suwon-si (KR); Chul Byung Park, Ansan-si (KR); Hyeon U Park, Suwon-si (KR); Seung-Jun Yoon, Suwon-si (KR); Jang Jung Lee, Hwaseong-si (KR); Jei Min Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 165 days.

(21) Appl. No.: 15/964,730

(22) Filed: Apr. 27, 2018

(65) Prior Publication Data

US 2018/0313569 A1 Nov. 1, 2018

(30) Foreign Application Priority Data

Apr. 28, 2017 (KR) ..... 10-2017-0055522

(51) Int. Cl.
*F24F 1/00* (2019.01)
*F24F 13/14* (2006.01)
(Continued)

(52) U.S. Cl.
CPC ..... *F24F 13/1426* (2013.01); *F24F 1/00* (2013.01); *F24F 1/0007* (2013.01);
(Continued)

(58) Field of Classification Search
CPC ..... F24F 13/1426; F24F 1/0047; F24F 1/00; F24F 1/0007; F24F 13/085;
(Continued)

(56) References Cited

U.S. PATENT DOCUMENTS 5,658,197 A * 8/1997 Kil ..... F24F 1/0011 454/314
2007/0129001 A1* 6/2007 Orr ..... F24F 11/0001 454/239
2014/0086735 A1* 3/2014 Huang ..... F24F 13/1486 415/200

FOREIGN PATENT DOCUMENTS

CN 102472521 5/2012
CN 105180267 12/2015
(Continued)

OTHER PUBLICATIONS

PCT International Search Report issued in PCT/KR2018/004231 dated Jul. 24, 2018 (total 3 pages).
(Continued)

*Primary Examiner* — Kenneth J Hansen
*Assistant Examiner* — Ryan L Faulkner
(74) *Attorney, Agent, or Firm* — Staas & Halsey, LLP

(57) ABSTRACT

An air conditioner includes a housing having a discharge port, a blade rotatably provided in the discharge port, a blade drive unit configured to rotate the blade, a first support member configured to rotatably support the blade and comprising a first blade coupling portion, a second support member configured to rotatably support the blade, located to be closer to the blade drive unit than the first support member, and comprising a second blade coupling portion having a size different from that of the first blade coupling portion.

12 Claims, 10 Drawing Sheets

(51) Int. Cl.
*F24F 13/08* (2006.01)
*F24F 1/0047* (2019.01)
*F24F 1/0007* (2019.01)

(52) U.S. Cl.
CPC ..... *F24F 1/0047* (2019.02); *F24F 13/085* (2013.01); *F24F 2013/1433* (2013.01)

(58) Field of Classification Search
CPC ..... F24F 2013/1433; F24F 13/1486; F24F 1/0025; F24F 1/0284
USPC ..... 454/358
See application file for complete search history.

(56) References Cited

FOREIGN PATENT DOCUMENTS

| | | | | |
|---|---|---|---|---|
| CN | 204901976 | U | 12/2015 | |
| EP | 2327938 | | 6/2011 | |
| EP | 2413058 | | 2/2012 | |
| EP | 3076088 | | 10/2016 | |
| JP | 05-10581 | | 1/1993 | |
| JP | 11-270896 | A | 10/1999 | |
| JP | 2006-162216 | A | 6/2006 | |
| JP | 2010-65876 | | 3/2010 | |
| JP | 2017-53524 | A | 3/2017 | |
| KR | 0126751 | | 3/1996 | |
| KR | 20-0178067 | | 4/2000 | |
| KR | 2000-0042330 | | 7/2000 | |
| KR | 10-0583415 | | 5/2006 | |
| KR | 10-0611322 | B1 | 8/2006 | |
| KR | 10-0786258 | | 12/2007 | |
| KR | 10-2010-0007259 | | 1/2010 | |
| KR | 10-2015-0102674 | | 9/2015 | |
| KR | 101742502 | B1 * | 6/2017 | ..... F24F 13/15 |

OTHER PUBLICATIONS

Extended European Search Report dated Feb. 28, 2020 in European Patent Application No. 18790058.4.
Notification of Second Office Action Issued by Chinese Patent Office for Chinese Application No. 201880028173.0 dated Jun. 4, 2021.
Chinese Office Action dated Jan. 4, 2021 in Chinese Patent Application No. 201880028173.0.
Korean Patent Office issued a Notice of Preliminary Rejection in Application No. 10-2017-0055522 dated Sep. 16, 2021.

* cited by examiner

AIR CONDITIONER

CROSS-REFERENCE TO RELATED APPLICATION(S)

This application claims the benefit of Korean Patent Application No. 10-2017-0055522, filed on Apr. 28, 2017 in the Korean Intellectual Property Office, the disclosure of which is incorporated herein by reference.

BACKGROUND

1. Field

Embodiments of the present disclosure relate to an air conditioner, and more particularly, to an air conditioner having an improved structure.

2. Description of the Related Art

In general, an air conditioner refers to an electronic device to improve thermal comfort by conditioning indoor air using a refrigeration cycle of a refrigerant and includes an indoor unit including a heat exchanger, a blower fan, and the like and located in an indoor room, an outdoor unit including a heat exchanger, a blower fan, a compressor, a condenser, and the like and located outside, and a refrigerant pipe to connect the outdoor unit and the indoor unit and circulate the refrigerant.

Air conditioners may be classified, according to installation location of indoor units, into standing-type air conditioners in which an indoor unit is mounted on the floor, wall-mounted air conditioners in which an indoor unit is installed at a wall, and ceiling-type air conditioners in which an indoor unit is installed at a ceiling. In a ceiling-type air conditioner, an indoor unit is recessed in or mounted on the ceiling.

Since an indoor unit of a ceiling-type air conditioner is installed at a ceiling, a suction port to suck air from an indoor room and a discharge port to return the air heat-exchanged by a heat exchanger to the indoor room are provided at lower portions of a main body. Indoor units of ceiling-type air conditioners may be classified, according to the number of discharge ports, into 1-way type indoor units in which one discharge port is provided and 4-way type indoor units in which four discharge ports are provided in a rectangular shape.

In general, an indoor unit of an air conditioner includes a blade disposed in a discharge port and configured to adjust a direction of heat-exchanged air which is discharged therethrough. The blade is rotatably coupled to one side of the discharge port. A motor is coupled to at least one side of the blade and the blade is rotated by a rotational force generated by the motor.

SUMMARY

Therefore, it is an aspect of the present disclosure to provide an air conditioner in which separation of one portion of a blade from a housing caused by a self-weight may be prevented when the blade closes a discharge port.

It is another aspect of the present disclosure to provide an air conditioner in which a strength of one portion of the housing in which the discharge port is arranged is reinforced.

It is another aspect of the present disclosure to provide an air conditioner having an improved external appearance.

It is another aspect of the present disclosure to provide an air conditioner discharging air by using various methods.

It is another aspect of the present disclosure to provide an air conditioner capable of cooling and/or heating an indoor room at a minimum wind speed to provide a user with comfort.

Additional aspects of the disclosure will be set forth in part in the description which follows and, in part, will be obvious from the description, or may be learned by practice of the disclosure.

In accordance with an aspect of the present disclosure, an air conditioner includes a housing having a discharge port, a blade rotatably provided in the discharge port, a blade drive unit configured to rotate the blade, a first support member configured to rotatably support the blade and comprising a first blade coupling portion, a second support member configured to rotatably support the blade, located to be closer to the blade drive unit than the first support member, and comprising a second blade coupling portion having a size different from a size of the first blade coupling portion.

The first blade coupling portion and the second blade coupling portion may have a hole shape, and the blade may have a first coupling protrusion rotatably inserted into the first blade coupling portion and a second coupling protrusion rotatably inserted into the second blade coupling portion.

A first central axis of the first blade coupling portion may be provided in a different manner from a second central axis of the second blade coupling portion.

The first central axis may be located eccentrically above the second central axis.

The first blade coupling portion may have a smaller diameter than a diameter of the second blade coupling portion.

The second coupling protrusion may have a smaller size than a size of the second blade coupling portion, and a rotation axis of the second coupling protrusion connected to the second blade coupling portion may move in a given section while the blade drive unit rotates the blade.

The blade drive unit may be provided at both ends of the blade, the first support member may be provided plural in number at a central region of the discharge port, the second support member may be provided at left and right sides of the discharge port.

At least one of the first support member and the second support member may be located to connect both ends of the discharge port in a widthwise direction.

The air conditioner may further include an air guide arranged in the discharge port to guide air discharged through the discharge port, and wherein the air guide may have an insertion groove into which one portion of the first support member or the second support member is inserted.

The air guide may be attachable to or a detachable from the housing through the discharge port.

When the blade closes the discharge port, the blade drive unit may further rotate the blade, even after one portion of one end of the blade is brought into contact with the housing, to bring a remaining portion of the end of the blade into contact with the housing as well.

The blade may be formed of a flexible material.

The housing may be installable at a ceiling.

The blade may be configured to open or close the discharge port.

The blade may have a plurality of air discharge holes to penetrate the blade.

In accordance with an aspect of an example embodiment, an air conditioner includes a housing installable at a ceiling and having a discharge port, a blade configured to rotate with respect to the housing to open or close the discharge port and having a plurality of air discharge holes, a blade drive unit configured to rotate the blade, a first support member configured to rotatably support the blade and comprising a first blade coupling portion having a hole shape, and a second support member configured to rotatably support the blade, located to be closer to the blade drive unit than the first support member, and comprising a second blade coupling portion having a hole shape with a diameter greater than a diameter of the first blade coupling portion.

A first central axis of the first blade coupling portion may be located eccentrically above a second central axis of the second blade coupling portion.

When the blade closes the discharge port, the blade drive unit may further rotate the blade, even after one portion of one end of the blade is brought into contact with the housing, to bring a remaining portion of the end of the blade into contact with the housing as well.

The blade may have a first coupling protrusion rotatably inserted into the first blade coupling portion and a second coupling protrusion rotatably inserted into the second blade coupling portion, and a rotation axis of the second coupling protrusion connected to the second blade coupling portion may move in a given section while the blade drive unit rotates the blade.

In accordance with an aspect of an example embodiment, an air conditioner includes a housing installable at a ceiling and having a discharge port, a blade configured to rotate with respect to the housing to open or close the discharge port and having a plurality of air discharge holes, a blade drive unit configured to rotate the blade, a first support member configured to rotatably support the blade and connect both ends of the discharge port in a widthwise direction, and a second support member configured to rotatably support the blade, located to be closer to the blade drive unit than the first support member, and configured to connect both ends of the discharge port in the widthwise direction, wherein when the blade closes the discharge port, the blade drive unit further rotates the blade, even after one portion of one end of the blade is brought into contact with the housing, to bring a remaining portion of the end of the blade into contact with the housing as well.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
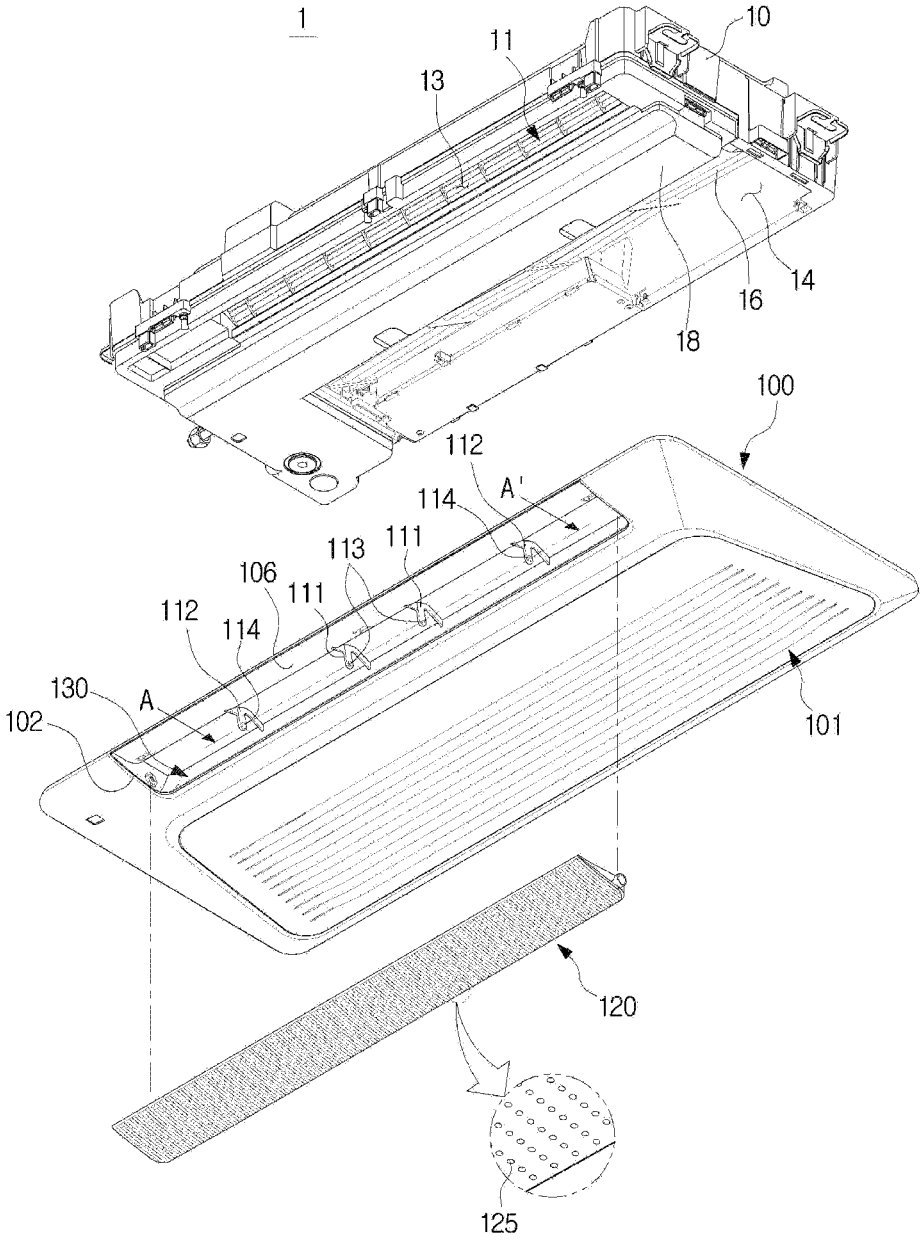
FIG. 1 is an exploded perspective illustrating an air conditioner and a blade applied thereto according to an embodiment.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are merely used to describe particular embodiments, and are not intended to limit the present disclosure. An expression used in the singular encompasses the expression of the plural, unless it has a clearly different meaning in the context. In the present specification, it is to be understood that the terms such as "including" or "having" are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It will be understood that, although the terms "first", "second", etc., may be used herein to describe various elements, these elements should not be limited by these terms. The above terms are used only to distinguish one component from another. For example, a first component discussed below could be termed a second component, and similarly, the second component may be termed the first component without departing from the teachings of this disclosure. As used herein, the term "and/or" includes any and all combinations of one or more of the associated listed items.

Meanwhile, it will be understood that if one element is located "in front of", "behind", "on", "under", "on the left of" or "on the right of" another element, it can be directly or indirectly located "in front of", "behind", "on", "under", "on the left of" or "on the right of", and the like are defined based on the drawings and the shape and position of each element are not limited by these terms.

A refrigeration cycle of an air conditioner is performed by using a compressor, a condenser, an expansion valve, and an evaporator. The refrigeration cycle includes a series of processes involving compression, condensation, expansion, and evaporation and supplies conditioned and heat-exchanged air with a refrigerant.

The compressor compresses a refrigerant gas in a high-temperature and high-pressure state and discharges the compressed refrigerant gas. The discharged refrigerant gas flows into the condenser. The condenser condenses the compressed refrigerant into a liquid phase and heat is released to the surroundings via a condensation process.

The expansion valve expands the liquid phase refrigerant in a high-temperature and high-pressure state condensed in the condenser into a liquid phase refrigerant in a low-pressure. The evaporator evaporates the refrigerant expanded in the expansion valve and returns the refrigerant gas in a low-temperature and low-pressure state to the compressor. The evaporator may achieve refrigeration effects via heat exchange with a material to be cooled using latent heat of evaporation of the refrigerant. The air conditioner may adjust temperature of an indoor space throughout this cycle.

An outdoor unit of the air conditioner refers to a part of the refrigeration cycle including the compressor and an outdoor heat exchanger. An indoor unit of the air conditioner includes an indoor heat exchanger, and the expansion valve may be provided in the indoor unit or the outdoor unit. The indoor heat exchanger and the outdoor heat exchanger serve as a condenser or an evaporator. When the indoor heat exchanger is used as a condenser, the air conditioner serves as a heater, and when the indoor heat exchanger is used as an evaporator, the air conditioner serves as a cooler.

Hereinafter, embodiments of the present disclosure will be described in detail with reference to the accompanying drawings.

Also, although an indoor unit of a ceiling-type air conditioner will be described by way of example for descriptive convenience, a blade according to an embodiment may also be applied to indoor units of any other types of air conditioners such as standing-type air conditioners and wall-mounted air conditioners.

Figure 2:
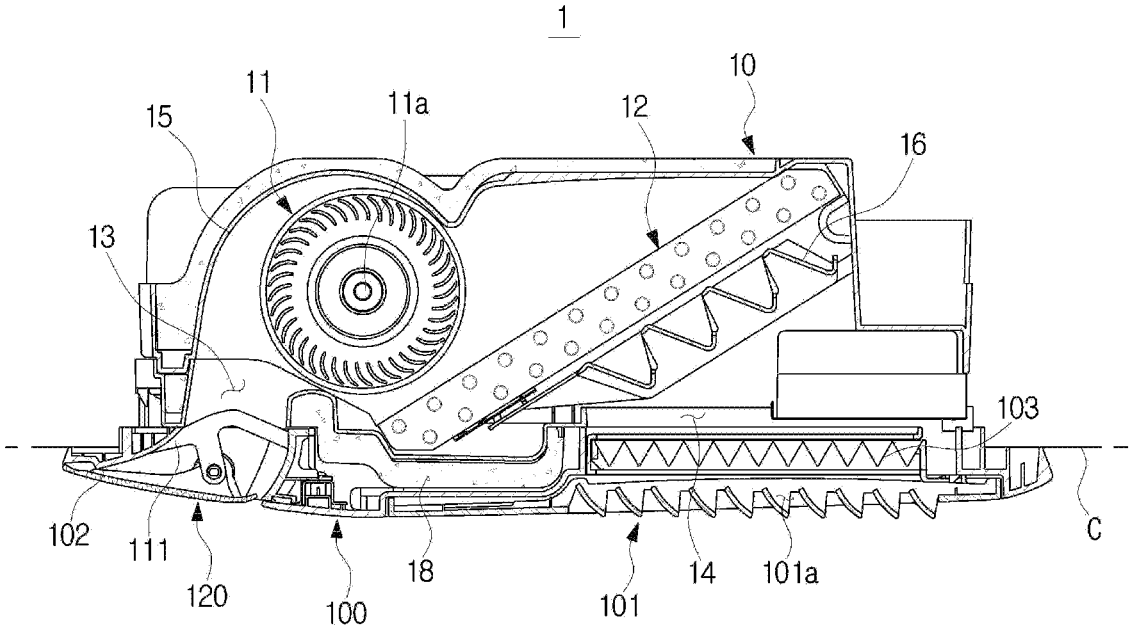
FIG. 2 is a cross-sectional view schematically illustrating the air conditioner of FIG. 1.

FIG. 1 is an exploded perspective illustrating an air conditioner 1 and a blade 120 applied thereto according to an embodiment. FIG. 2 is a cross-sectional view schematically illustrating the air conditioner 1 of FIG. 1.

Referring to FIGS. 1 and 2, the air conditioner 1 according to an embodiment may include a main body 10 mounted on a ceiling C or recessed in the ceiling and a housing 100 coupled to a lower portion of the main body 10.

The main body 10 may be formed in an approximate box-shape. The main body 10 may include a heat exchanger 12 to perform heat exchange between sucked indoor air and a refrigerant, a blower fan 11 forcibly blowing air, and a control unit (not shown) to control the operation of the air conditioner 1.

The main body 10 includes an upper surface and side surfaces constituting front, rear, left, and right sides. The main body 10 may include a scrolling device 15 configured to guide air heat-exchanged while passing through the heat exchanger 12 toward an air discharge port 13.

A suction port 14 to suck air from an indoor room into the main body 10 and the air discharge port 13 to return heat-exchanged air into the indoor room may be provided at lower portions of the main body 10. The air discharge port 13 may be provided with a wind direction adjusting member (not shown) to control a lateral direction of the discharged air.

The heat exchanger 12 may include a tube in which the refrigerant flows and heat exchanging fins in contact with the tube to increase a heat transfer area. The heat exchanger 12 may be inclined to be approximately perpendicular to a direction of an air flow.

A guide rib 16 to guide the indoor air sucked into the main body 10 through the suction port 14 toward the heat exchanger 12 may be located between the heat exchanger 12 and the suction port 14. The guide rib 16 may be inclined to be approximately perpendicular to an arranged direction of the heat exchanger 12.

A drain cover 18 to collect condensate generated in the heat exchanger 12 may be located under the heat exchanger 12. Condensate collected in the drain cover 18 may be drained out through a drain hose (not shown).

The blower fan 11 may forcibly blow air while being rotated by a driving force of a drive motor (not shown). A rotary shaft 11*a* of the blower fan 11 may be arranged in approximately parallel with the ground. The blower fan 11 may be a cross-flow fan.

The housing 100 may include a grille 101 provided at a position corresponding to the suction port 14 to prevent foreign substances from entering the main body 10 and a panel discharge port 102 located at a position corresponding to the air discharge port 13. The blade 120 may be rotatably provided at the panel discharge port 102 to open or close the panel discharge port 102 or adjust a vertical direction of discharged air. Since the panel discharge port 102 is provided in the housing 100 and connected to the air discharge port 13, both the air discharge port 13 and the panel discharge port 102 will be collectively referred to as a discharge port 102 hereinafter.

The housing 100 may include a filter member 103 to remove foreign substances from air sucked into the main body 10 through the suction port 14.

Since the filter member 103 needs to be cleaned or replaced due to a lot of foreign substances stacked thereon after use, the grille 101 may be provided to be selectively opened from the housing 100 to easily separate the filter member 103 therefrom. The grille 101 may be fixed to the housing 100 at a rear portion and rotatable to be opened or closed in a state of being supported.

The grille 101 may include a grille suction port 101*a* located in front of the filter member 103 of the housing 100 and at least partially cut.

Hereinafter, the housing 100 and the blade 120 according to an embodiment will be described in more detail.

Figure 3:
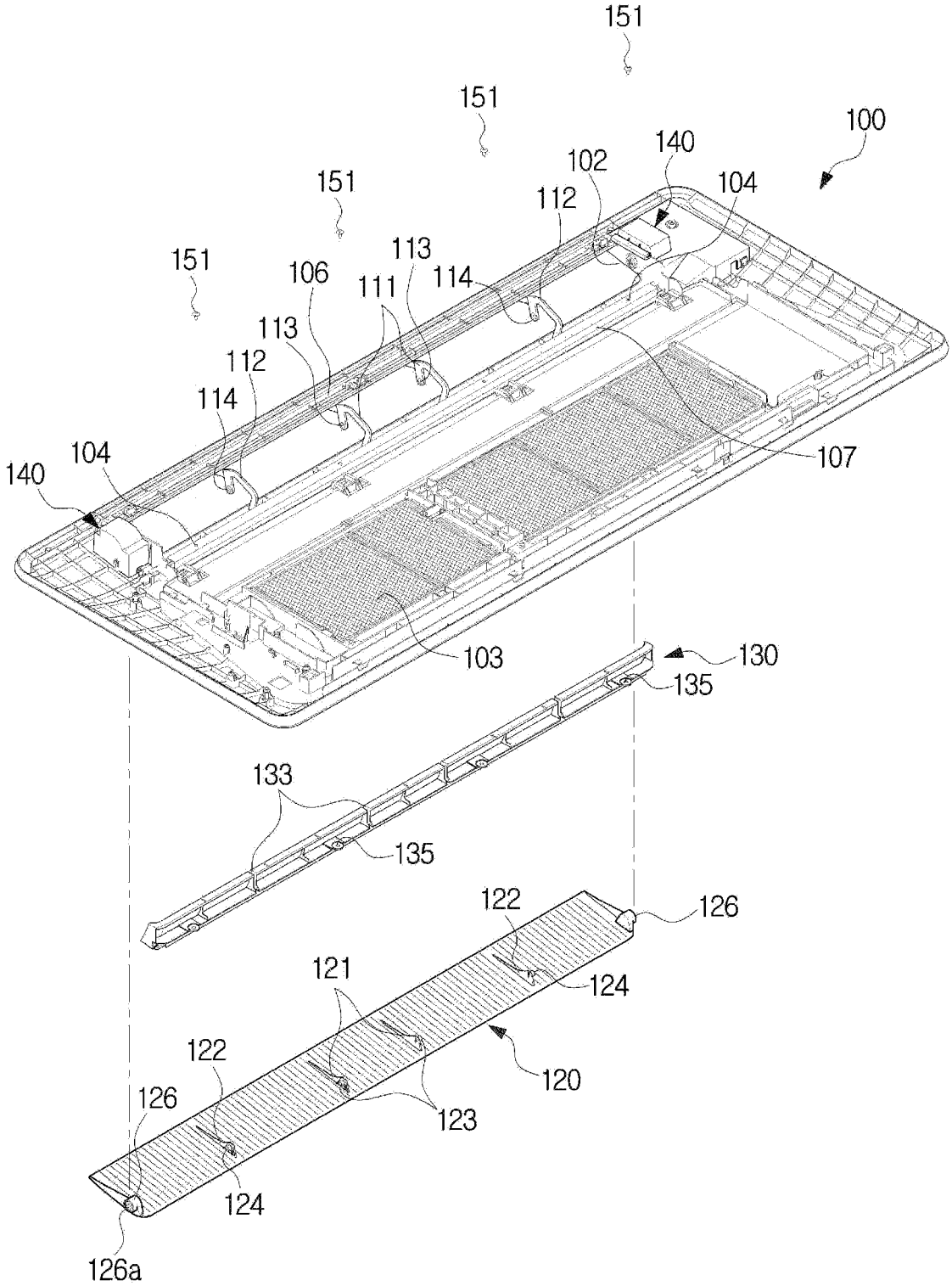
FIG. 3 is an exploded view illustrating the housing, the blade, and an air guide of the air conditioner illustrated in FIG. 1.
Figure 4:
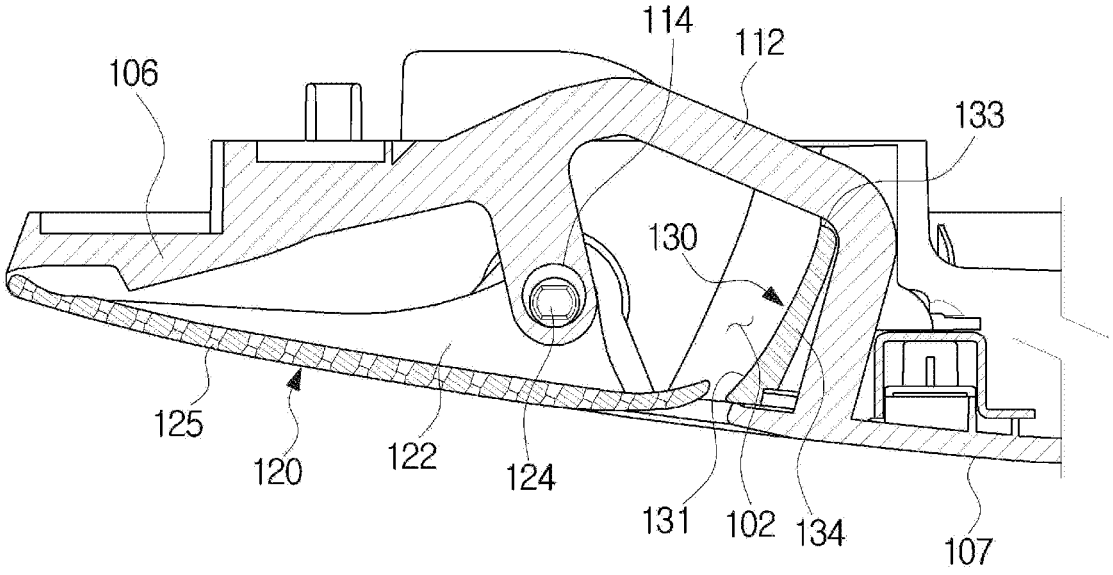
FIG. 4 is a side cross-sectional view of the discharge port in which a second support member of the air conditioner shown in FIG. 1 is located.
Figure 5:
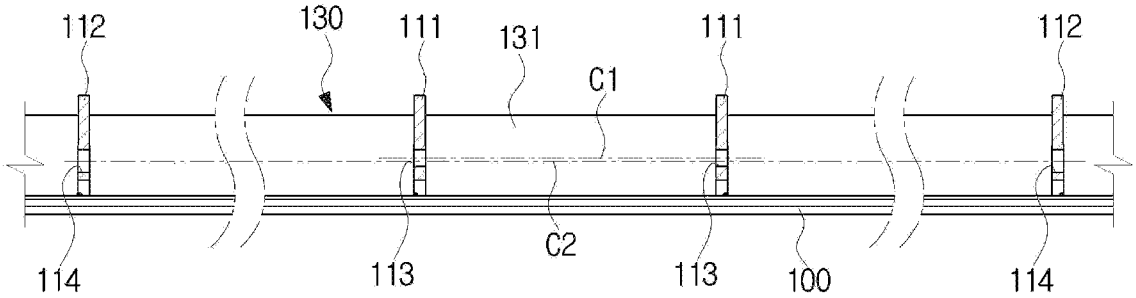
FIG. 5 is a cross-sectional view taken along line A-A' shown in FIG. 1.

FIG. 3 is an exploded view illustrating the housing 100, the blade 120, and an air guide 130 of the air conditioner 1 illustrated in FIG. 1. FIG. 4 is a side cross-sectional view of the discharge port 102 in which a second support member 112 of the air conditioner 1 shown in FIG. 1 is located. FIG. 5 is a cross-sectional view taken along line A-A' shown in FIG. 1.

The housing 100 may include a first support member 111 and a second support member 112 which rotatably support the blade 120. The housing 100 may include a plurality of first support members 111 and a plurality of second support members 112. When the housing 100 includes the plurality of first support members 111 and the plurality of second support members 112, structures of the plurality of first support members 111 may be the same and structures of the plurality of second support members 112 may be the same. Hereinafter, descriptions of only one first support member 111 and only one second support member 112 will be given for descriptive convenience since the plurality of first support members 111 have the same structure and the plurality of second support members 112 have the same structure.

The first support member 111 may extend to connect a front portion 106 of the housing 100 constituting a front end of the discharge port 102 with a rear portion 107 of the housing 100 constituting a rear end of the discharge port 102. The first support member 111 may be formed to connect both ends of the discharge port 102 in a widthwise direction.

The first support member 111 may have a first blade coupling portion 113. The first blade coupling portion 113 may have a hole shape. A first coupling 123 of a first extended portion 121 may be rotatably inserted into the first blade coupling portion 113.

The second support member 112 may extend to connect a front portion 106 of the housing 100 constituting the front end of the discharge port 102 with a rear portion 107 of the housing 100 constituting the rear end of the discharge port 102. The second support member 112 may be formed to connect both ends of the discharge port 102 in the widthwise direction.

At least one of the first support member 111 and the second support member 112 may be disposed to connect both ends of the discharge port 102 in the widthwise direction (a forward and backward direction in FIG. 1). Since the first support member 111 and/or the second support member 112 are formed to connect the front portion 106 of the housing 100 with the rear portion 107 of the housing 100, bending, distortion, or deflection of the front portion 106 of the housing 100 having a relatively small length in a forward and backward direction may be prevented. That is, the first support member 111 and the second support member 112 may reinforce strength of the front portion 106 of the housing 100.

The second support member 112 may have a second blade coupling portion 114. The second blade coupling portion 114 may have a hole shape. A second coupling protrusion 124 of a second extended portion 122 may be rotatably inserted into the second blade coupling portion 114.

The second support member 112 may be arranged closer to a blade drive unit 140 than the first support member 111. That is, the blade drive units 140 may be provided at both ends in a lengthwise direction. The first support members 111 may be arranged to support an approximately central portion of the blade 120, and the second support members 112 may be arranged to support side portions of the blade 120 respectively.

However, unlike the embodiment illustrated in FIG. 3, only one first support member 111 may be provided at an approximately central portion of the blade 120. Also, unlike the embodiment illustrated in FIG. 3, more than two second support members 112 may be provided at both side portions of the blade 120 respectively. The numbers of the first support member 111 and the second support member 112 may vary as needed.

The second blade coupling portion 114 may have a size different from that of the first blade coupling portion 113. A diameter of the second blade coupling portion 114 may be greater than that of the first blade coupling portion 113.

The first blade coupling portion 113 may be about the same size as the first coupling protrusion 123. The first coupling protrusion 123 may have a little smaller size than the first blade coupling portion 113 to be inserted into the first blade coupling portion 113 in a rotatable state.

The second blade coupling portion 114 may be a little greater than the second coupling protrusion 124. The second coupling protrusion 124 may be provided such that a rotation axis thereof moves in a state of being coupled to the second blade coupling portion 114.

Referring to FIG. 5, a first central axis C1 of the first blade coupling portion 113 may be different from a second central axis C2 of the second blade coupling portion 114. Particularly, the first central axis C1 may be located eccentrically above the second central axis C2. Thus, when the blade 120 is rotatably supported by the first support member 111 and the second support member 112, the first coupling protrusion 123 and the second coupling protrusion 124 may be located to have the same rotation axis or different rotation axes.

The first coupling protrusion 123 may have about the same size as the second coupling protrusion 124.

The blade 120 may be rotatably provided in the discharge port 102. As the blade 120 rotates in the discharge port 102, the discharge port 102 may be opened or closed. The blade 120 may be located in a closing position where the discharge port 102 is closed. The blade 120 may rotate to control a direction of air blown from the blower fan 11 and discharged through the discharge port 102 by opening the discharge port 102. The blade 120 may rotate within a predetermined angle with respect to the housing 100 to control the direction of air discharged through the discharge port 102. The blade 120 may be formed of a flexible material to be easily coupled to the housing 100.

The blade 120 may include the first coupling protrusion 123 rotatably inserted into the first blade coupling portion 113 and the second coupling protrusion 124 rotatably inserted into the second blade coupling portion 114.

The first coupling protrusion 123 may be disposed at the first extended portion 121 protruding from an upper surface of the blade 120, and the second coupling protrusion 124 may be disposed at the second extended portion 122 protruding from the upper surface of the blade 120. The first extended portion 121 may be arranged to correspond to the first support member 111 and the second extended portion 122 may be arranged to correspond to the second support member 112.

The first coupling protrusion 123 may be rotatably inserted into the first blade coupling portion 113. The first coupling protrusion 123 may be provided to have a diameter approximately the same as that of the first blade coupling portion 113. A rotation axis of the first coupling protrusion 123 may be fixed while the blade 120 rotates.

The second coupling protrusion 124 may be rotatably inserted into the second blade coupling portion 114. The second coupling protrusion 124 may be provided to have a diameter smaller than that of the second blade coupling portion 114. A rotation axis of the second coupling protrusion 124 may move in a given section while the blade 120 rotates.

The blade 120 may have a plurality of air discharge holes 125 penetrating the blade 120. Air passing through the discharge port 102 may be discharged out of the housing 100 through the plurality of air discharge holes 125. The plurality of air discharge holes 125 may be distributed to be spaced at regular intervals. However, the embodiment is not limited thereto and the air discharge holes 125 may also be concentrated in a predetermined region of the blade 120.

Since the air conditioner 1 discharges air through the plurality of air discharge holes 120, air may be discharged out of the housing 100 at a low speed. Accordingly, the user may achieve the purpose of air conditioning with no direct wind and thus the air conditioner 1 may improve satisfaction of the user.

Although the blade 120 including the plurality of air discharge holes 125 has been described according to the present embodiment, the spirit of the present disclosure may also be applied to air conditioners including a blade with no plurality of air discharge holes.

The blade 120 may include drive unit coupling portions 126 to be coupled to the blade drive units 140 at both ends. When the blade drive unit 140 is provided at only one end, the drive unit coupling portion 126 may also be provided at only one end of the blade 120.

The drive unit coupling portion 126 may have a drive unit insertion groove 126*a* to which one portion of the blade drive unit 140 is inserted. The portion of the blade drive unit 140 inserted into the drive unit insertion groove 126*a* may have a polygonal pillar shape such that the blade 120 receives a rotational force from the blade drive unit 140. The drive unit insertion groove 126*a* may be formed in a shape corresponding to the polygonal pillar shape of the portion of the blade drive unit 140.

The air conditioner 1 may include an air guide air guide 130 located in the discharge port 102 and configured to guide air discharged through the discharge port 102. The air guide 130 may include a curved guide surface to guide the air. The air guide 130 may be detachably coupled to the housing 100 through the discharge port 102. The air guide 130 may be provided to be assembled to the housing 100 through the discharge port 102 in an upward direction.

The air guide 130 may have support member insertion grooves 133 into which the first support member 111 and/or second support member 112 are partially inserted. The support member insertion groove 133 may accommodate one portion of each of the first support member 111 and the second support member 112 extending in the forward and backward direction of the discharge port 102.

A front portion of the support member insertion groove 133 may be covered with a cover 134. Since one portion of each of the first support member 111 and the second support member 112 extending forward is inserted into the support member insertion groove 133 and the other portion thereof extending backward from the inserted portion into the support member insertion groove 133 is covered with the cover 134, the quality of appearance may be improved when the discharge port 102 is opened.

The air guide 130 may include a fixing portion 135 fixed to the housing 100. The air guide 130 may be fixed to the housing 100 when a fastening member 151 is coupled to the fixing portion 135 in a state where the air guide 130 is mounted on the housing 100.

The air conditioner 1 may include the blade drive units 140 located at both ends of the blade 120 and configured to rotate the blade 120. Although FIG. 3 illustrates that the blade drive units 140 are arranged at both ends of the blade 120, the blade drive unit 140 may also be provided at only one end of the blade 120. The blade drive unit 140 may include a drive source and a power transmitting member. An elastic member may be disposed between the blade drive unit 140 and the blade 120 to reduce noise and vibration caused while the blade 120 rotates.

When the blade drive unit 140 is provided at only one end of the blade 120, the second support member 112 may be provided only one portion closer to the one end of the blade 120 in which the blade drive unit 140 is located. Also, the first support member 111 may additionally be provided at another portion farther from the one end of the blade 120 provided with the blade drive unit 140.

That is, one portion of the blade 120 farther from the one end of the blade 120 provided with the blade drive unit 140 receives a smaller torque from the blade drive unit 140. Thus, one side portion of the blade 120 closer to the blade drive unit 140 needs to be rotated more than another side portion of the blade 120 farther from the blade drive unit 140 by a predetermined angle such that the side portion of the blade 120 farther from the blade drive unit 140 is brought into close contact with the housing 100.

Figure 6:
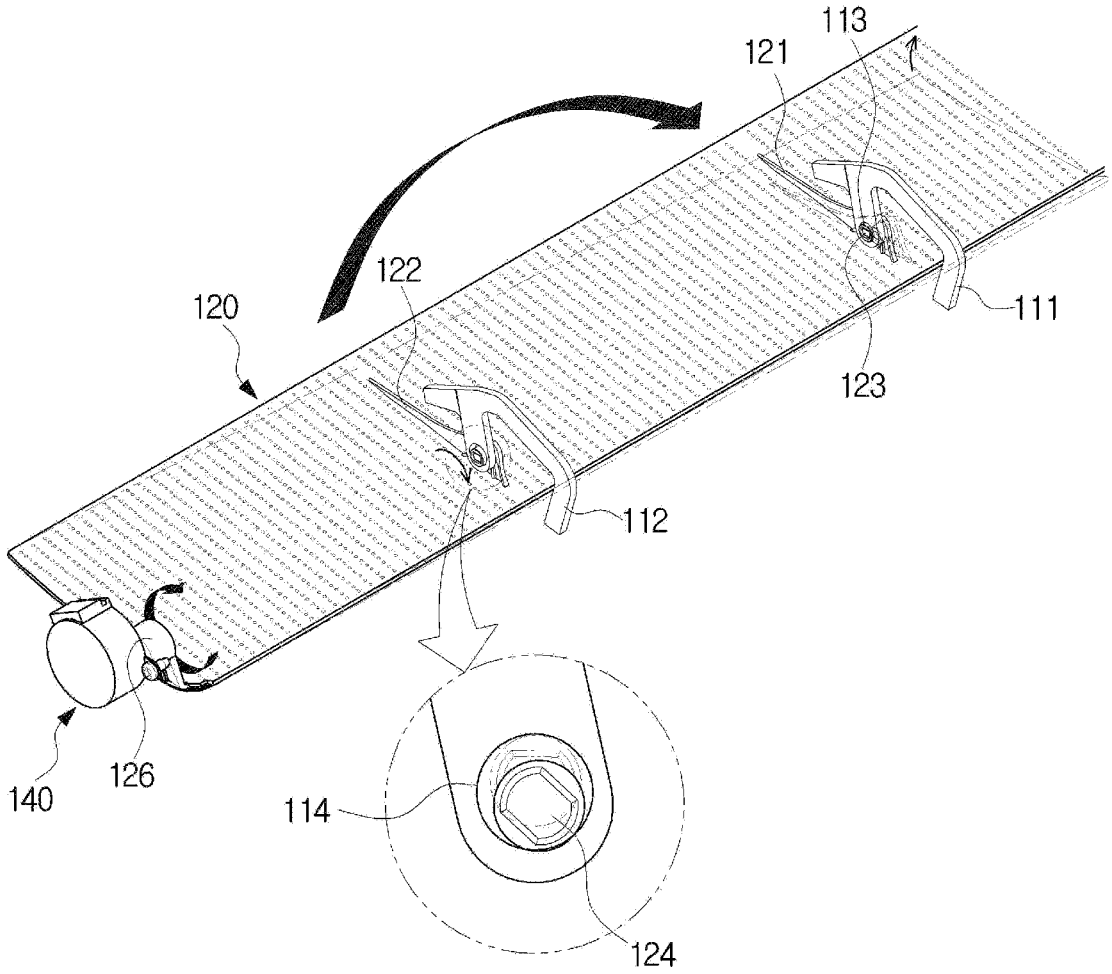
FIG. 6 is a diagram illustrating motion of the second coupling protrusion when the blade illustrated in FIG. 1 closes the discharge port.

FIG. 6 is a diagram illustrating motion of the second coupling protrusion 124 when the blade 120 illustrated in FIG. 1 closes the discharge port 102.

Referring to FIG. 6, the motion of the blade 120 when the blade 120 closes the discharge port 102 will be described.

When the blade 120 closes the discharge port 102, one side portion of the blade 120 closer to the blade drive unit 140 may be brought into close contact with the housing 100. On the contrary, a central portion of the blade 120 farther from the blade drive unit 140 may not be brought into close contact with the housing 100 due to a weak torque received from the blade drive unit 140 and a self-weight thereof.

The blade drive unit 140 of the air conditioner 1 illustrated in FIG. 1 may further rotate the blade 120 even after the one side portion of the blade 120 closer to the blade drive unit 140 is brought into close contact with the housing 100 such that the central portion of the blade 120 is brought into close contact with the housing 100.

In this case, the rotation axis of the second coupling protrusion 124 coupled to the second blade coupling portion 114 of the second support member 112 may move. The rotation axis of the first coupling protrusion 123 may be about the same as that of the second coupling protrusion 124 until the one side portion of the blade 120 closer to the blade drive unit 140 is brought into close contact with the housing 100. After the one side portion of the blade 120 closer to the blade drive unit 140 is brought into close contact with the housing 100, the rotation axis of the second coupling protrusion 124 moves downward while the first coupling protrusion 123 is maintained at the approximately same rotation axis. That is, since the one side portion of the blade 120 is already in close contact with the housing 100, the rotation axis of the second coupling protrusion 124 may rotatably move about the one portion in close contact with the housing 100.

Thus, the blade 120 of the air conditioner 1 may be brought into close contact with the housing 100 when the blade 120 closes the discharge port 102. Also, when the blade 120 completely closes the discharge port 102, the air conditioner 1 may cool and/or heat the indoor room through the blade 120 with a minimum wind speed providing the user with comfort.

FIGS. 7 to 10 are diagrams for sequentially describing a process of coupling the air guide 130 to the housing 100 illustrated in FIG. 1.

Referring to FIGS. 7 to 10, the process of coupling the air guide 130 to the housing 100 of the air conditioner 1 will be described.

Conventionally, a support member is provided in a cantilever shape from a front portion of a housing, and thus an air guide is coupled to the housing from an upper portion of a discharge port in a downward direction. However, in the air conditioner 1 according to an embodiment, the first support member 111 and the second support member 112 extend in the widthwise direction of the discharge port 102. Thus, when the air guide 130 is coupled to the housing 100 in the downward direction, the first support member 111 and the second support member 112 are exposed to the outside in an open state of the discharge port 102, thereby deteriorating the quality of appearance.

Figure 7:
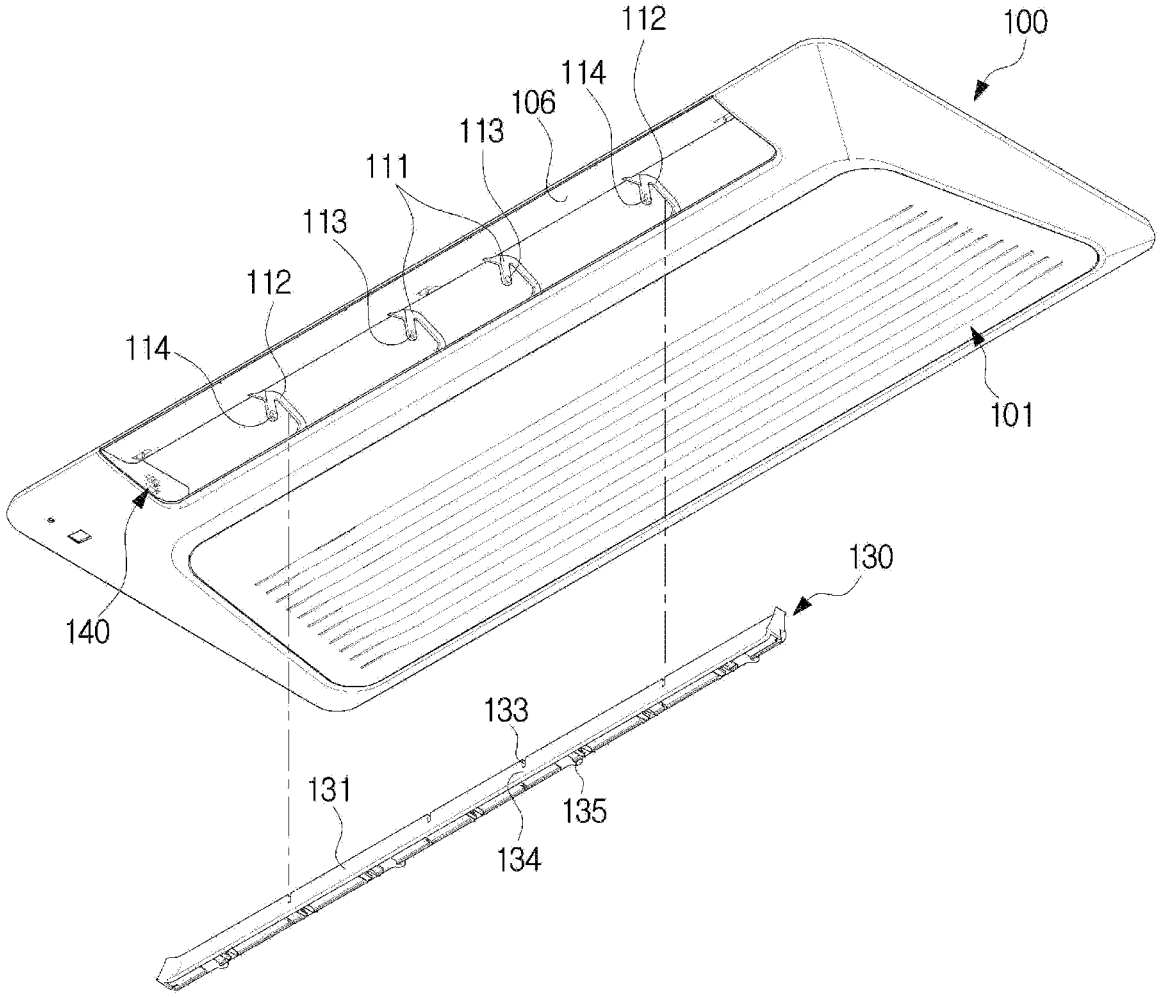
FIGS. 7 to 10 are diagrams for sequentially describing a process of coupling the air guide to the housing illustrated in FIG. 1.

Accordingly, referring to FIG. 7, the air guide 130 may be coupled to the housing 100 in the upward direction from a lower portion of the discharge port 102. The air guide 130 may move toward the inside of the discharge port 102 such that the first support member 111 and the second support member 112 are inserted into the support member insertion grooves 133.

Figure 8:
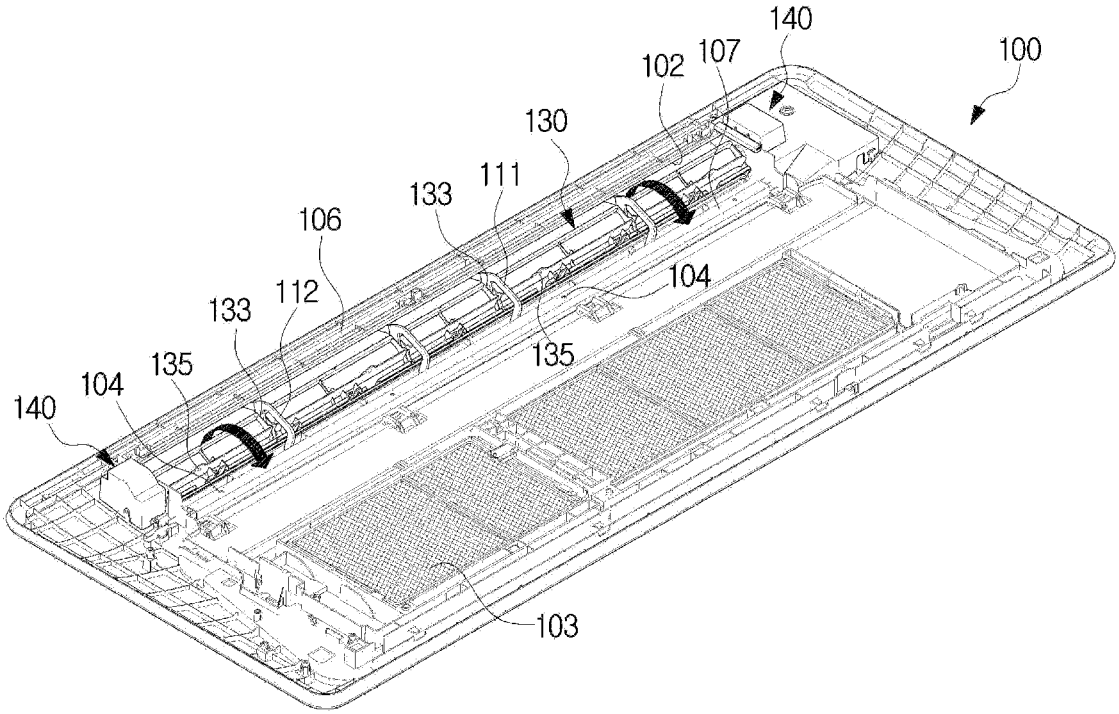

Referring to FIG. 8, the air guide 130 enters the discharge port 102 in a state where the front end thereof is tilted forward. That is, the air guide 130 enters the discharge port 102 in a tilted state such that the fixing portion 135 located at a rear lower rear portion first enters the rear portion 107 of the housing 100.

Figure 9:
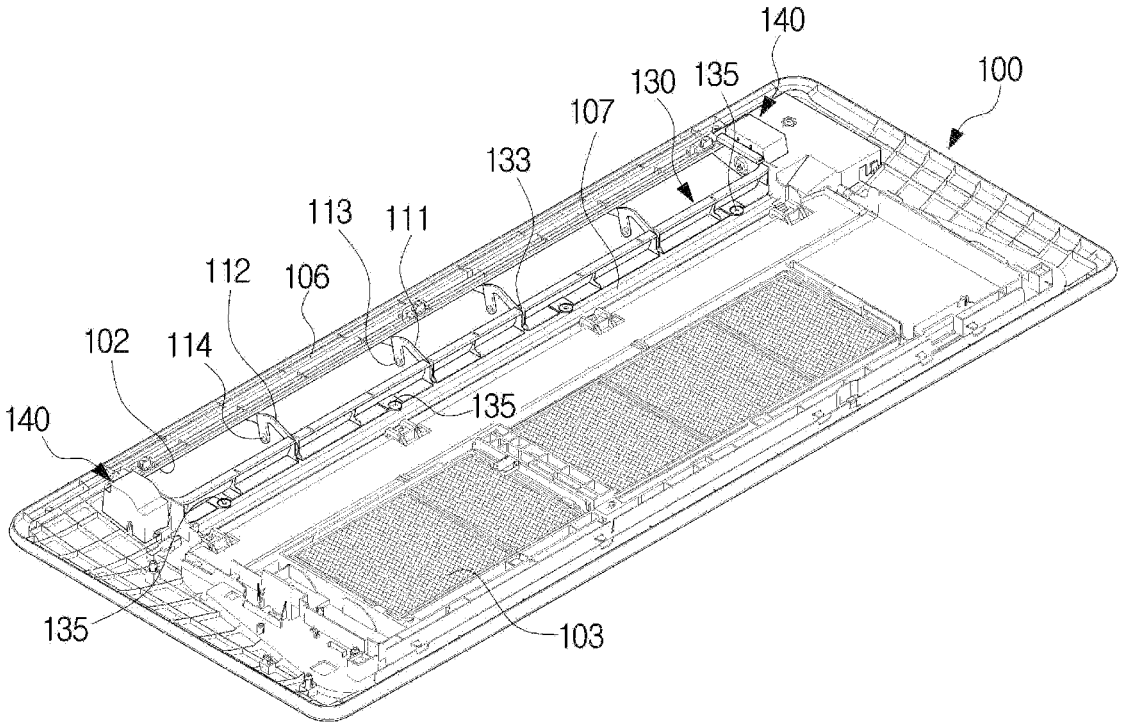

Next, referring to FIG. 9, the air guide 130 may rotatably move such that the first support member 111 and the second support member 112 are inserted into the support member insertion grooves 133 and the fixing portion 135 meets a fixing hole 104 of the housing 100.

Figure 10:
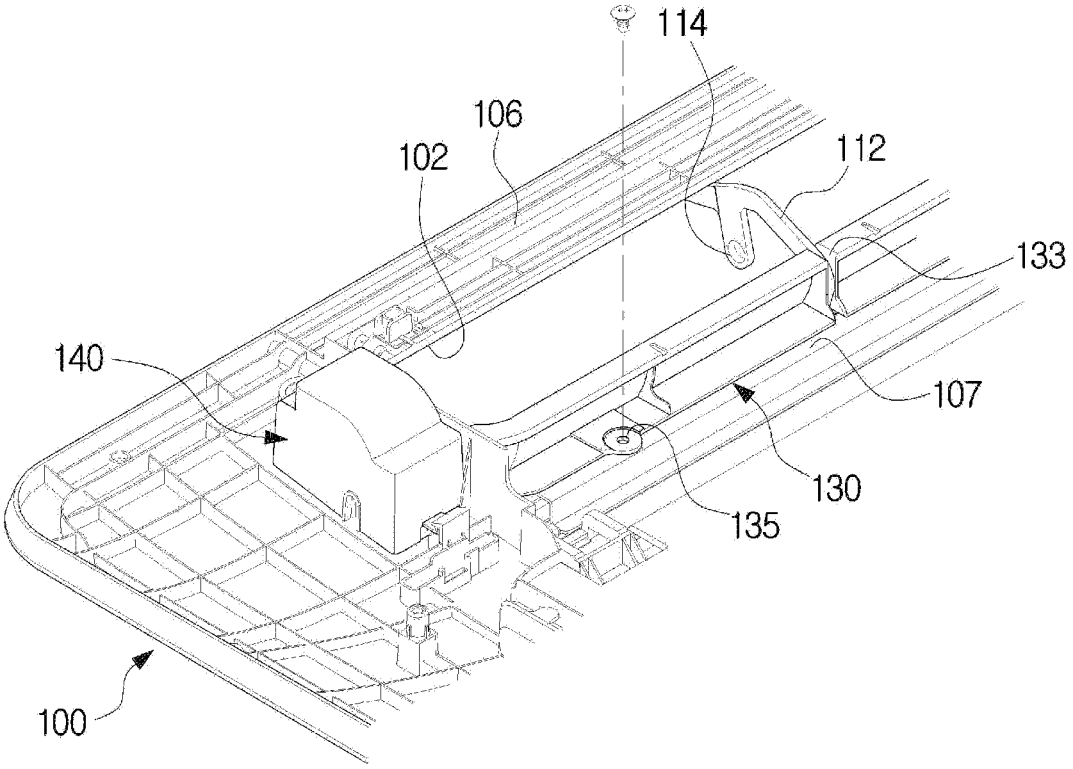

Referring to FIG. 10, after the air guide 130 is mounted to the housing 100, the air guide 130 may be fixed to the housing 100 by the fastening member 151. The fastening member 151 may penetrate the fixing portion 135 and the fixing hole 104 and fix the air guide 130 to the housing 100.

Since the air guide 130 is coupled to the housing 100 as described above, the air conditioner 1 may minimize exposed areas of the first support member 111 and the second support member 112 in a state where the blade 120 opens the discharge port 102, thereby improving the quality of appearance.

As is apparent from the above description, since the plurality of blade coupling portions rotatably supporting the blade have different sizes, the air conditioner according to an embodiment may rotate the blade such that one portion of the blade spaced apart from the housing due to the self-weight thereof is brought into contact with the housing when the blade closes the discharging port.

The air conditioner according to an embodiment may reinforce the strength of weak portions of the housing since the support members support the weak portions of the housing in which the discharge port is arranged.

The air conditioner according to an embodiment may have improved appearance since the air guide covers one portion of the support member.

The air conditioner according to an embodiment may discharge air using various methods since the blade has the plurality of aid discharge holes.

The air conditioner according to an embodiment may cool and/or heat the indoor room at a minimum wind speed providing the user with comfort since the blade has the plurality of air discharge holes.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising: a housing having a discharge port; a blade to rotatably open or close the discharge port, the blade including a drive unit coupling portion disposed in one end of the blade, a first coupling protrusion disposed in a first blade portion of the blade, and a second coupling protrusion disposed in a second blade portion of the blade, and disposed between the first coupling protrusion and the drive unit coupling portion; a blade drive unit disposed in the housing and rotatably coupled to the drive unit coupling portion, configured to rotate the blade within a predetermined angle with respect to the housing to control a direction of air discharged through the discharge port and to open or close the discharge port; a first support member disposed in the housing and including a first blade coupling portion rotatably coupled to the first coupling protrusion, and configured to rotatably support the first blade portion; a second support member disposed closer to the blade drive unit than the first support member in the housing and including a second blade coupling portion rotatably coupled to the second coupling protrusion, and configured to rotatably support the second blade portion, wherein the second blade portion, which is disposed closer to the blade drive unit than the first blade portion, receives larger torque than torque received by the first blade portion so that when the blade is rotated to the predetermined angle by the blade drive unit to close the discharge port, the second blade portion of the blade first contacts with the housing to partially close the discharge port, and then the first blade portion of the blade contacts with the housing to close the discharge port, thereby closing the discharge port by the blade, and wherein the second blade coupling portion has a second hole with a size larger than a size of a first hole of the first blade coupling portion so that the second blade coupling protrusion is configured to rotatably support the second blade portion to rotate more than the first blade portion after the second blade portion contacts with the housing to close the discharge port by the blade, and wherein the first coupling protrusion rotates about a first central axis of the first blade coupling portion and the second coupling protrusion rotates about a second central axis of the second blade coupling portion, and the second central axis is located eccentrically below the first central axis.

2. The air conditioner of claim 1, wherein the first hole has a smaller diameter than a diameter of the second hole.

3. The air conditioner of claim 1, wherein the second coupling protrusion has a smaller size than a size of the second blade coupling portion, and the second central axis of the second coupling protrusion connected to the second blade coupling portion moves in a given section while the blade drive unit rotates the blade.

4. The air conditioner of claim 1, wherein the blade drive unit is provided at both ends of the blade, respectively, the first support member includes a plurality of first supports members configured to rotatably support the first portion of the blade, and the second support member is located to be closer to the blade drive unit, respectively so that the second support member is respectively provided at an outside of the plurality of first support members.

5. The air conditioner of claim 1, wherein the discharge port includes a front end and a rear end and wherein at least one of the first support member and the second support member is extended to be connected to the front end of the discharge port and the rear end of the discharge port.

6. The air conditioner of claim 5, further comprising an air guide arranged in the discharge port to guide air discharged through the discharge port, and wherein the air guide has a support member insertion groove into which one portion of the first support member or the second support member is inserted.

7. The air conditioner of claim 6, wherein the air guide is attachable to or detachable from the housing through the discharge port.

8. The air conditioner of claim 1, wherein the blade is formed of a flexible material.

9. The air conditioner of claim 1, wherein the housing is installable at a ceiling.

10. The air conditioner of claim 1, wherein the blade has a plurality of air discharge holes to penetrate the blade.

11. An air conditioner comprising: a housing installable at a ceiling and having a discharge port; a blade configured to rotate with respect to the housing to open or close the discharge port and having a plurality of air discharge holes, the blade including a drive unit coupling portion disposed in one end of the blade, a first coupling protrusion disposed in a first blade portion of the blade, and a second coupling protrusion disposed in a second blade portion of the blade, and disposed between the first coupling protrusion and the drive unit coupling portion; a blade drive unit disposed in the housing and rotatably coupled to the drive unit coupling portion, configured to rotate the blade within a predetermined angle with respect to the housing to control a direction of air discharged through the discharge port and to open or close the discharge port; a first support member disposed in the housing and including a first blade coupling portion, formed of a first hole, rotatably coupled to the first coupling protrusion, configured to rotatably support the first blade portion; and a second support member disposed closer to the blade drive unit than the first support member in the housing and including a second blade coupling portion, formed of a second hole having a diameter greater than a diameter of the first hole, rotatably coupled to the second coupling protrusion, and configured to rotatably support the second blade portion, wherein the second blade portion, which is disposed closer to the blade drive unit than the first blade portion, receives larger torque than torque received by the first blade portion so that when the blade is rotated to the predetermined angle by the blade drive unit to close the discharge port, the second blade portion of the blade first contacts with the housing to partially close the discharge port, and then the first blade portion of the blade contacts with the housing to close the discharge port, thereby closing the discharge port by the blade, wherein the second blade coupling portion has a second size larger than a size of the first blade coupling portion so that the second blade coupling protrusion is configured to rotatably support the second blade portion to rotate more than the first blade portion after the second blade portion contacts with the housing to close the discharge port by the blade, and wherein the first coupling protrusion rotates about a first central axis of the first blade coupling portion and the second coupling protrusion rotates about a second central axis of the second blade coupling portion, and the second central axis is located eccentrically below the first central axis.

12. An air conditioner comprising: a housing installable at a ceiling and having a discharge port, the discharge port including a front end and a rear end; a blade configured to rotate with respect to the housing to open or close the discharge port and having a plurality of air discharge holes, the blade including a drive unit coupling portion disposed in one end of the blade, a first coupling protrusion disposed in a first blade portion of the blade, and a second coupling protrusion disposed in a second blade portion of the blade, and disposed between the first coupling protrusion and the drive unit coupling portion; a blade drive unit disposed in the housing and rotatably coupled to the drive unit coupling portion, configured to rotate the blade within a predetermined angle with respect to the housing to control a direction of air discharged through the discharge port and to open or close the discharge port; a first support member disposed in the housing and including a first blade coupling portion, formed of a first hole, rotatably coupled to the first coupling protrusion, configured to rotatably support the first blade portion and be extended to be connected to the front end of the discharge port and the rear end of the discharge port; and a second support member disposed closer to the blade drive unit than the first support member in the housing and including a second blade coupling portion, formed of a second hole having a diameter greater than a diameter of the first hole, rotatably coupled to the second coupling protrusion, configured to rotatably support the second blade portion, and configured to be extended to be connected to the front end of the discharge port and the rear end, wherein the second blade portion, which is disposed closer to the blade drive unit than the first blade portion, receives larger torque than torque received by the first blade portion so that when the blade is rotated to the predetermined angle by the blade drive unit to close the discharge port, the second blade portion of the blade first contacts with the housing to partially close the discharge port, and then the first blade portion of the blade contacts with the housing to close the discharge port, thereby closing the discharge port by the blade, wherein the second blade coupling portion has a size larger than a size of the first blade coupling portion so that the second blade coupling protrusion is configured to rotatably support the second blade portion to rotate more than the first blade portion after the second blade portion contacts with the housing to close the discharge port by the blade, and wherein the first coupling protrusion rotates about a first central axis of the first blade coupling portion and the second coupling protrusion rotates about a second central axis of the second blade coupling portion, and the second central axis is located eccentrically below the first central axis.

* * * * *